United States Patent [19]

Frederick et al.

[11] 4,099,387

[45] Jul. 11, 1978

[54] SHEET STEEL PILE CLAMP

[76] Inventors: Leonard L. Frederick, 15 Crestview Ter., Whippany, N.J. 07981; Edwin E. Greigg, 509 Notley Rd., Silver Spring, Md. 20904

[21] Appl. No.: 747,134

[22] Filed: Dec. 3, 1976

Related U.S. Application Data

[60] Division of Ser. No. 672,447, Mar. 31, 1976, abandoned, which is a continuation of Ser. No. 486,624, Jul. 8, 1974, abandoned.

[51] Int. Cl.[2] ..... E02D 11/00

[52] U.S. Cl. ..... 61/63; 61/58; 173/57

[58] Field of Search ..... 61/53.5, 63; 173/57; 279/20; 175/170

[56] References Cited

U.S. PATENT DOCUMENTS

| | | | |
|---|---|---|---|
| 2,023,966 | 12/1935 | Montee | 173/57 X |
| 3,101,956 | 8/1963 | Müller | 61/53.5 |
| 3,232,359 | 2/1966 | Baglow | 173/57 |
| 3,763,941 | 10/1973 | Leibee et al. | 173/57 |

*Primary Examiner*—Jacob Shapiro
*Attorney, Agent, or Firm*—Edwin E. Greigg

[57] ABSTRACT

The invention relates to a method and apparatus for producing steel piling and a machine for driving the same in earthen strata and further teaches fabrication of the steel piling either by a rolling mill or an extrusion machine, said piling being provided with integral portions that are later deformed to produce longitudinally extending ducts that are suitably pierced to jet streams of water carried by the ducts to the opposed sides of a section of piling.

11 Claims, 13 Drawing Figures

64
16'
SP

SP
62
16
138

SP
16
61
61
16

90
86
116

FIG. 6
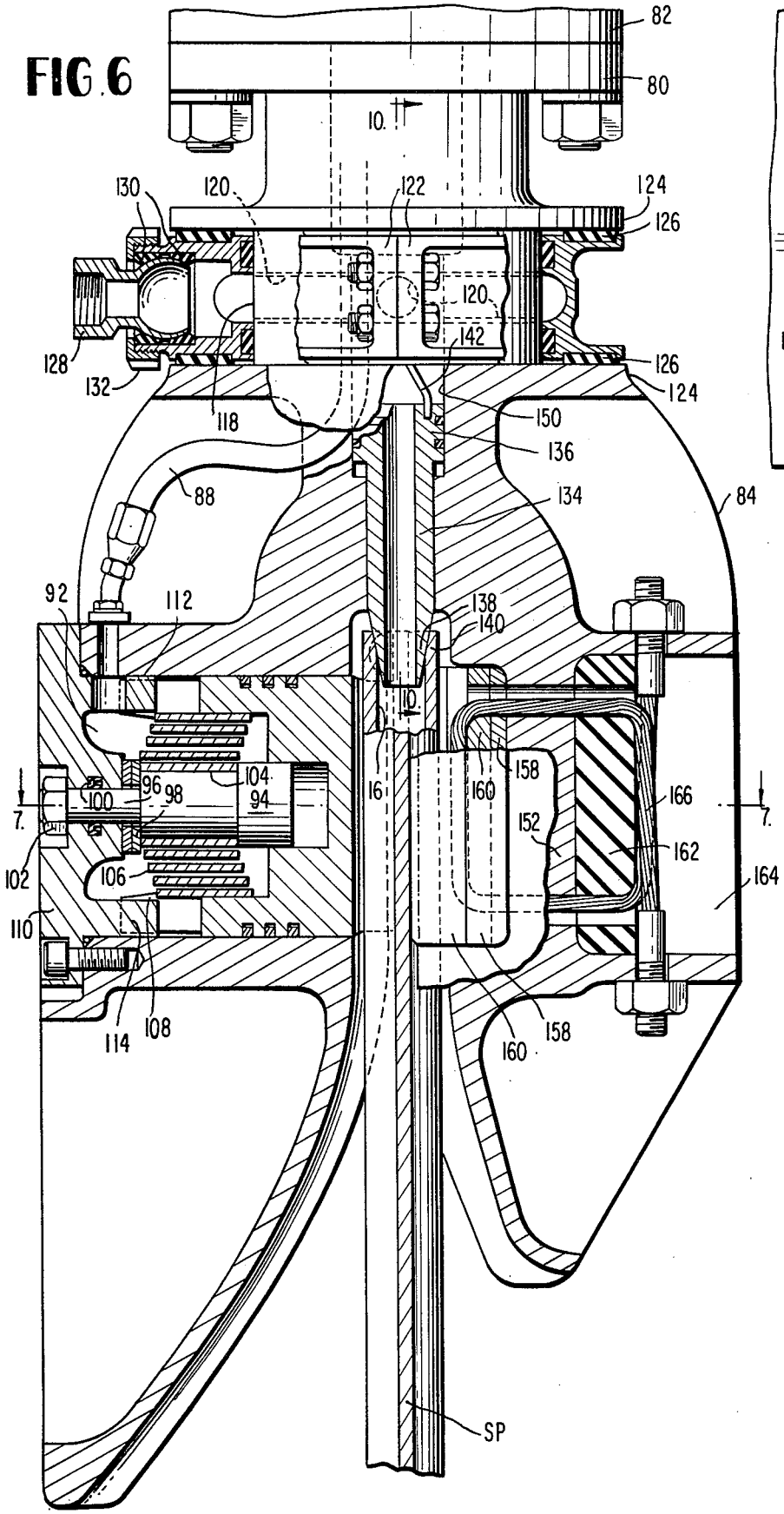
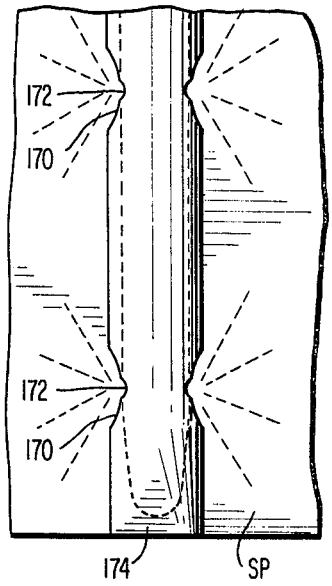
FIG. 11
FIG. 12
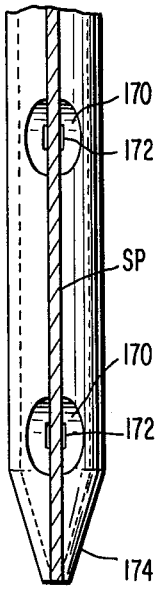

SHEET STEEL PILE CLAMP

This is a division of application Ser. No. 672,447, filed Mar. 31, 1976, now abandoned, which application is a continuation of application Ser. No. 486,624, filed July 8, 1974, now abandoned.

BACKGROUND OF THE INVENTION

This invention relates to further improvements in the sheet steel pile art as disclosed in my earlier application Ser. No. 293,444, filed Sept. 29, 1972 now U.S. Pat. No. 3,822,557.

In my earlier application, it was disclosed that the principal object of the invention was to provide a system of controlled lubrication of the driven ends and longitudinally extending surfaces of all sheet steel piling.

That invention has particular applicability for use either with the automatic impact hammer or the high frequency vibrator, the latter having had several shortcomings since it was limited more or less to soil strata formations that are more or less granular. Because the high frequency vibrator has certain drawbacks in its use with different types of soil, excessive amounts of force have been developed, but increased range has been limited from 5% to 10%. Thus, that improvement alleviated or reduced soil strata adhesion to the sheet pile surface through the use of properly placed water jets which broadens the use of the high frequency vibrator to include the entire range of sheet pile driving.

Further, there was described in that application a system of lubrication for sheet steel piling that not only enabled the pile to be more quickly driven into the earth's strata, but also to be extracted therefrom by the vibrator or the automatic impact extractor.

In addition, there is disclosed in that application a system in which standard mill rolled sheet steel piles sections could be converted to perform the function revealed therein, by simple meld fabrication methods as well as also the possibility of a steel rolling mill to form the linear ducts or conduits which conduct the liquid along the extent of the surface of the sheet piling.

OBJECTS OF THE INVENTION

The primary object of the present invention is to teach a method of making a structural sheet steel pile and the product resulting therefrom by an extrusion machine or a rolling mill which will further reduce the overall cost of the sheet piling manufacture.

A further object of the invention is to teach a method of rolling preformed portions of a sheet steel pile as it is discharged from the extrusion machine or rolling mill by progressively pre-heating predetermined areas, where required, of the sheet piling so they may be brought into juxtaposed relation and melded together by a final rolling operation.

A still further object of the invention is to apply fusion heat continuously and directly to the edge portion of offstanding wing-shaped portions so they may be melted together during the rolling operation.

Another object of this invention is to provide a duct and orifice system that can be universally used for all types of piles, i.e., arched, "Z" and flat sections and readily adaptable to the same vice clamp provided with a water injector.

Still another object of this invention is to provide an economical method of mass production of sheet steel piling which includes ducts and orifices.

A still further object of this invention is to provide an orifice system for the ducts of the sheet pile that can be formed therein either while the sheet is hot or milled thereinto after it is cold.

Another object of this invention is to provide a means at the top of the pile so that a water connection can be made quickly at the same time the pile clamp is being attached to the top of the sheet pile.

Yet another object of this invention is to provide a method of hot forming the bottom of the pile to close the lower end of the duct to thereby produce a pointed knife-like lower edge surface to thereby facilitate driving of the sheet pile.

Yet still another object of this invention is to provide a method of hot flaring and reaming of the mouth and the duct adjacent to the top of the pile to facilitate the entrance of the injector and thereafter proper sealing of the mouth of the duct with the injector.

These and other objects of the present invention will become more apparent from a reading of the following specification taken in conjunction with the drawings, in which:

BRIEF DESCRIPTION OF THE DRAWINGS

FIG. 6 is a side view of the sheet pile clamp showing the operative components thereof in cross-section;

FIG. 11 is a fragmentary elevational view of a milled duct work on a piling;

FIG. 12 is a fragmentary side elevational view of the structure of FIG. 11.

DETAILED DESCRIPTION

Figure 1:
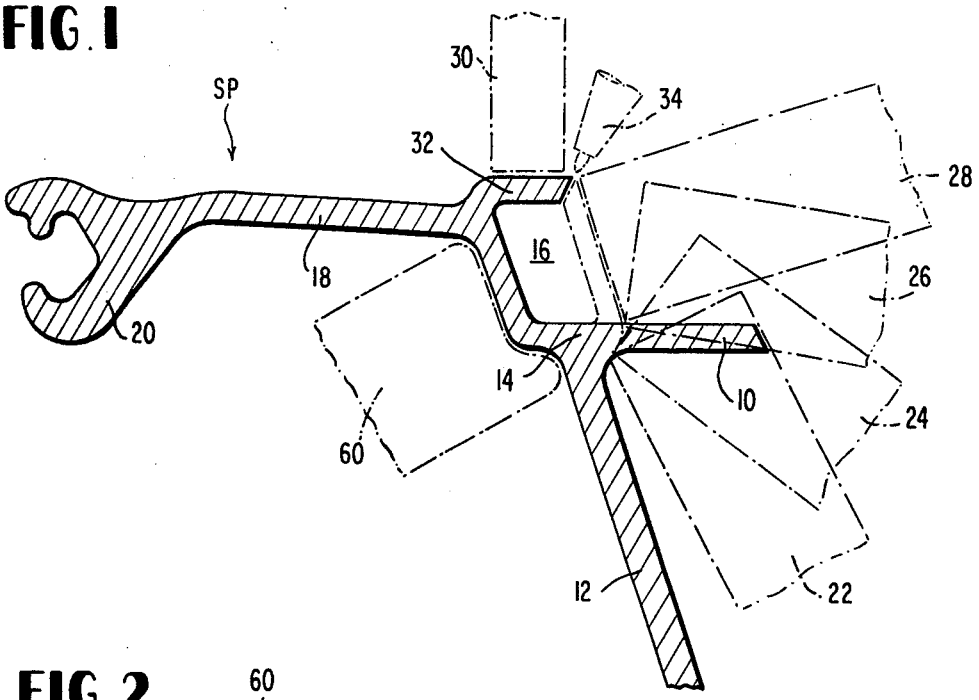
FIG. 1 is a fragmentary sectional view of a Z-shaped pile showing schematically the progression of the rolling mill steps to achieve compartmentalization of the liquid carrying chamber.

Turning now to the drawing, in FIG. 1 reference is made initially to the fact that it is to be assumed that the Z-shaped sheet steel pile section shown in this view has already been either roll formed in a rolling mill or has been extruded from an extrusion machine (not shown), at which time the leg or wing portion 10 offstands substantially at an angle of 72° from the plane of the web member 12 and is coplanar with the wall 14 of the duct or compartment 16 that will subsequently conduct the liquid to be discharged over the surface areas of the web members when the compartment is properly formed.

In FIG. 1 is also shown a second integral offstanding web member 18, to the terminal portion of which is formed a suitable connector means that does not form any part of the invention disclosure, being known to the prior art.

With further reference to FIG. 1 there is also shown in dotted outline a series of rolling mill rolls 22, 24, 26 and 28, the function of each of which will now be described.

As the sheet steel piling is discharged from the machine it still has a temperature of in excess of 2000° F, according to the type and composition of the steel and thus is capable of being rolled further and deformed. At the time of the discharge of the Z-shaped sheet steel piling shown in FIG. 1 from the machine, the wing or leg portion 10 offstands at substantially 72° to the web 12 and generally lies in a plane parallel with the web 18. Immediately upon discharge from the machine and prior to any apprecible temperature decrease in the steel piling, the leg portion 10 is brought into contact with the first rolling machine roll 11 which will bend the leg portion through its initial stage backwardly toward the web 18 thus beginning the formation of the liquid carrying compartment 16.

From the foregoing it is believed to be now clear that the remainder of the rolling mill rolls 24, 26 and 28 through which the sheet piling will pass are canted relative to the angle of approach of the leg portion as it emerges from its initial state of deformation as previously explained so that these additional rolls will serve to deform the leg portion shown in FIG. 1 from the full line position there shown finally to substantially a closed condition. Simultaneously with rolling mill roll 28 gaining access to the surface area of the leg portion to urge it into a contacting position with wall 32, as shown, the rolling roll 30 is brought into contact with the short wall 32 of the compartment 16 and simultaneously therewith the fusion heating element 34 increases the temperature of the juxtaposed extremities of the leg portions 10 and 32 to a sufficient degree that they will meld together and thus provide a suitably sealed longitudinally extending liquid supporting compartment.

Figure 2:
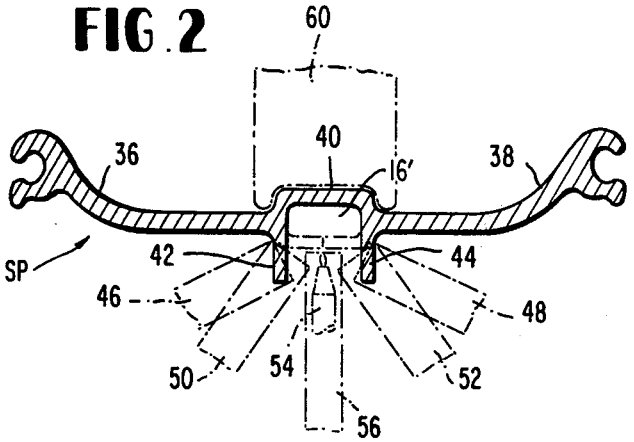
FIG. 2 is a sectional view of a sheet piling showing a further embodiment of a progressive rolling mill operation, to achieve compartmentalization of the liquid carrying chamber in a flat sheet pile section.

With regard to the formation of the compartment in the flat sheet pile section showing in FIG. 2, it will be observed that in this instance the compartment consists of a rear wall 40 and a pair of outwardly projecting leg portions 42 and 44, respectively, all of which are integrally formed with the web portions, as shown. In view of the earlier explanation herein in connection with the rolling mill action that takes place when the sheet piling is discharged from the machine, it is believed that it will suffice to say that when the flat sheet piling shown in FIG. 2 emerges from the machine at the elevated temperatures stated hereinbefore, that the leg portions 42 and 44 are initially brought into contact with the first set of rolling mill rolls 46 and 48, to begin the convergent deformation thereof.

Immediately upon these leg portions being deformed sufficiently to pass beyond the influence of the first set of rolls they are contacted by the second set of rolls 50 and 52, which thus deform these portions inwardly still further, as can be well appreciated from an inspection of the view of FIG. 2, which shows the progression of steps that the piling goes through to attain a compartmentalized condition for the liquid supporting cavity 16'. It will also be noted that the final step is to subject the leg portions 42 and 44 to the rolling operation of the final roll 56 at which time the compartment is completely sealed against leakage. Of course, depending upon the temperature of the leg portions it may be necessary to subject them to the fusion heating element 54 to increase the temperature thereof to assure a satisfactory sealed condition of the duct.

Figure 3:
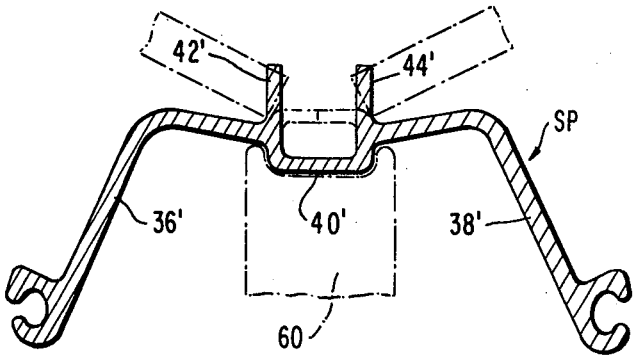
FIG. 3 is a further embodiment in cross-section of an arched sheet pile section showing the rolling operation to achieve compartmentalization of the liquid chamber.

In FIG. 3 there is shown a still further type of arched sheet steel piling which includes web portions 36' and 38' which are integrated substantially medially thereof by an elongated open chamber including a back wall 40' and parallel offstanding leg portions 42' and 44' respectively, this entire structure also being integrally formed with each of the leg portions being capable of being deformed in the same manner as by the several steps described earlier in connection with the structure shown in FIG. 2.

It will be observed that in each of FIGS. 1, 2 and 3 a back-up roll 60 is shown in dotted outline, and its use is contemplated where found to be necessary to a more satisfactory forming operation.

Figures 4, 5, 8, 9:
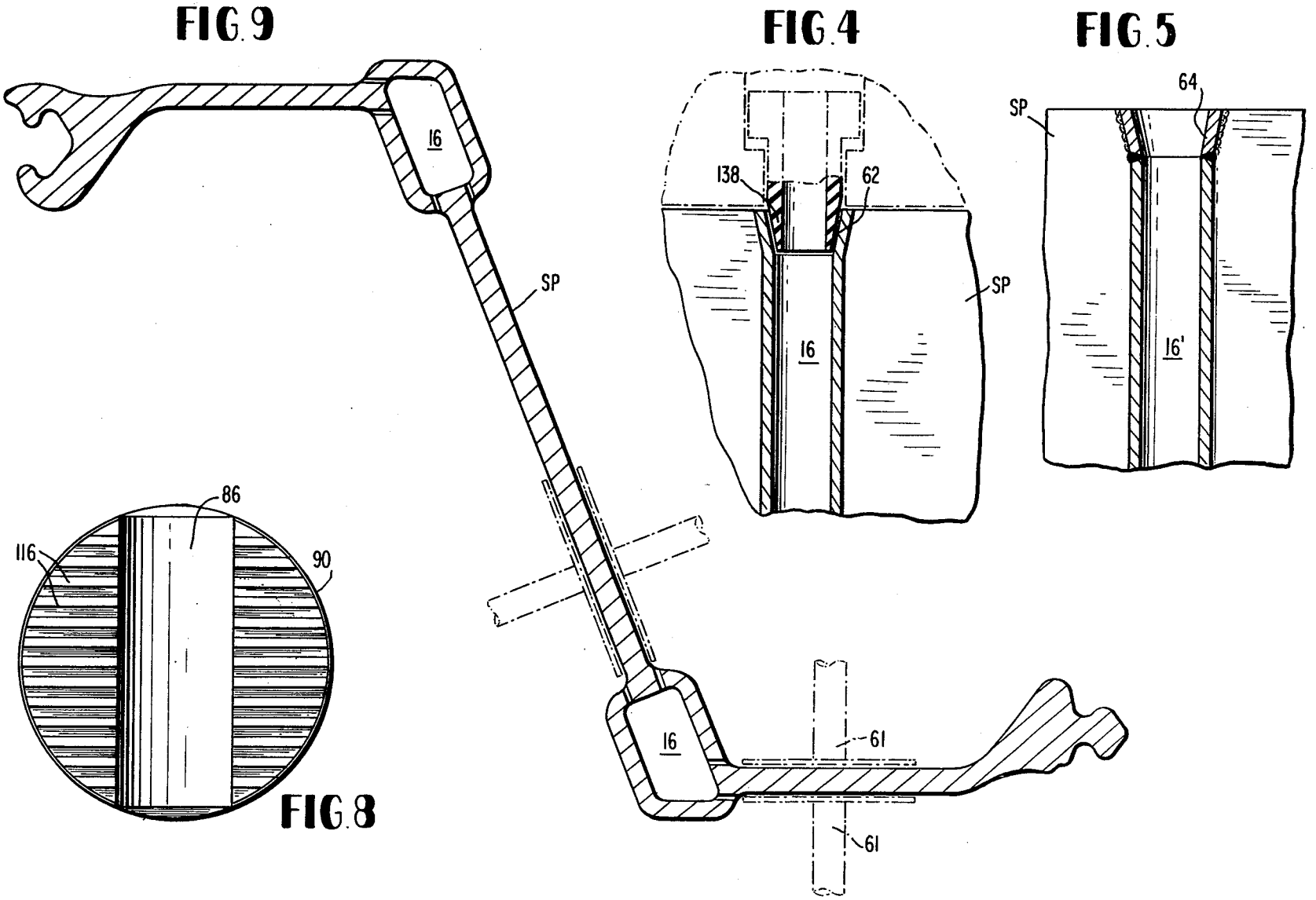
FIG. 4 is a fragmentary view of a portion of sheet piling showing the mouth of the duct with the piston seated therein.
FIG. 5 is another fragmentary view showing a flared end welded to the top of the duct.
FIG. 8 is an end elevational view of the serrated front face of the hydraulically actuated piston.
FIG. 9 shows a typical Z-shaped section of sheet pile with flush spindle mill cutters performing a plunge cut in the duct to provide liquid discharge openings.

Reference is made at this time to FIG. 4 which shows in a fragmentary view a top portion of the sheet steel piling SP with the duct 16 provided with a mouth portion 62 which may be formed while the sheet is still hot and thereafter reamed so that the inner surface area thereof will be properly sealed with the hard rubber nose portion of the injector 138 when it is driven thereinto by water pressure all of which will become apparent as this description progresses.

Though reference has been made only to the view in FIG. 4 and an explanation given as to how a flaring operation is conducted on a portion of that particular sheet, it is contemplated that this operation can be performed as well on any of the structures shown in FIGS. 1, 2 and 3.

The view in FIG. 5 is a further embodiment of the invention which shows a flatened duct 16' and an inserted flared mouth section 64 that is welded into position after the sheet pile rolling is finished.

Turning now to the structure of FIG. 6 there is shown partially in an elevational side view and partially in cross-section a new type of universal sheet pile clamp 80 that is shown in position over the top of a length of sheet steel piling SP preparatory for the driving operation.

This view clearly discloses a pair of jaw-like members (see view of FIG. 7 which is a section on line 7—7 of FIG. 6) that are arranged to grasp the sheet piling during the driving operation with one of the jaw-like members being hydraulically actuated and having a longer leg portion, the purpose of which will be understood as this description progresses, while the other is arranged in such a manner that it can compensate for lateral adjustment of the jaws relative to the piling duct.

Vibratory hammers adapted for use in pile driving are well-known to those skilled in the sheet steel pile driving art and the present invention forms an adjunct for use therewith. Vibratory hammers of the type referred to include an exciter which develops a sinusoidal standing wave, with no side motion, having an approximate amplitude of $\frac{1}{8}$ to $\frac{3}{4}$ and a force of 70 to 100 tons. Thus, it will be apparent that such a vibratory structure would require a very strong grip on the top of the pile and with the invention of the type of sheet piling disclosed herein a new type of clamp for positioning between the vibratory hammer and the sheet piling became necessary.

Only the lower supporting surface of the vibratory hammer is revealed at 82 and to this the pile clamp 80 is suitably attached by bolts.

With further reference to FIG. 6, it will be noted that the pile clamp 80 includes a body portion 84 that is provided with opposed pistons that are arranged to straddle the duct 16 of the sheet steel piling and include complementally formed concave recesses 86-86, respectively, (FIG. 7) for this purpose with one of the pistons, namely 90, being hydraulically advanced by power supplied from the exciter 82 through the conduit 88 to the chamber 92.

The piston 90 includes in the center thereof a guide member 94 which is provided with a threaded stem 96 that extends through tensioning washers 98 and a seal 100 and terminates exteriorly of the chamber 92 in a lock nut 102.

It will be observed also that the guide member 94 has an annular undercut portion 104 which is adapted to receive a portion of the volute spring 106 with a still further portion of the spring 106 being fastened to a part of the piston as shown at 108. Further, the piston 90 and cylinder cap 110 are complementally notched as at 112 and 114 to prevent rotation of the piston 90 within the chamber 92. In order that there will be less of a tendency for the piston to rotate in its chamber, it is provided on its front surface 116 with serrations all of which will be understood by reference to the end elevational view of the piston which is shown in FIG. 8.

Turning again to FIG. 6, it will be noted that in the upper area of the body portion 84 there is provided a reduced neck portion 118 which includes plural apertures 120-120 equally spaced thereabout for a purpose that will now be explained.

The elements comprising the split collar 122 are suitably bolted about the neck portion, as shown, and held in spaced relation relative to the main body portion 84 and the inner surface of the annular flange 124—124 by upper and lower shock absorbent pads 126—126, respectively.

Water is introduced through a hose (not shown) to the nipple 128 which is swivelably mounted in seals 130—130 and held fast therebetween by a nut 132. The water emitted to this connection passes through the plural apertures 120—120 and thence downwardly into the elongated passageway in the nozzle injector 134 with the force of the water which impacts the annular piston-like surface 136 serving to drive the tapered terminus 138 of injector 134 firmly down into the complementally tapered throat 140 provided at the top of the duct 16.

Figure 10:
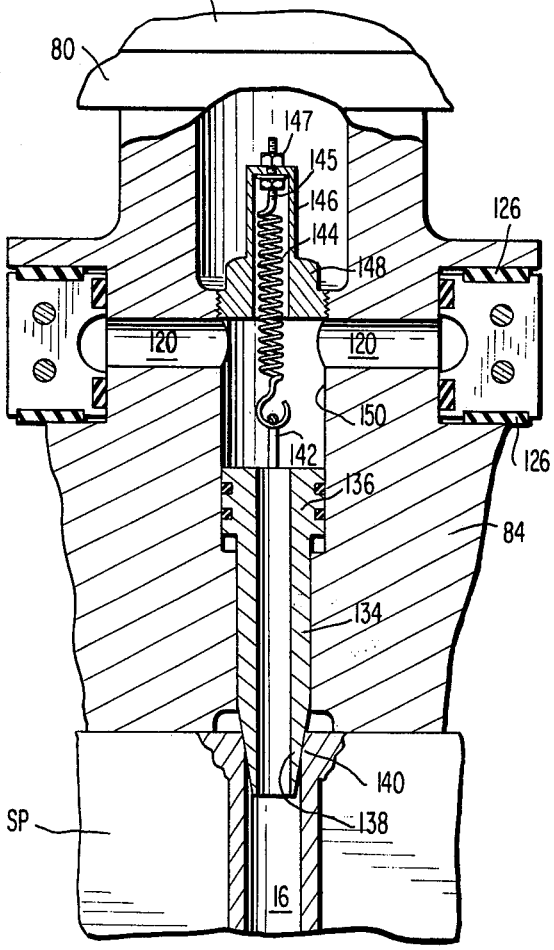
FIG. 10 is a fragmentary sectional view of the nozzle injector and its associated support element taken along line 10—10 of FIG. 6.

By referring at this time to the schematic view of the collar in FIG. 10, it will be noted that the piston-like injector 136 which includes a bail member 142 is held in a retracted position and out of the piling duct by a support spring 144.

The upper extremity of the spring 144 includes a threaded post 145 which passes through the perforated top of the housing 146 and is securely fastened therein by a lock nut assembly 147. The housing 146 is integral with the nut 148 and serves to close the chamber 150 which is filled with water during the pile setting operation.

Figure 7:
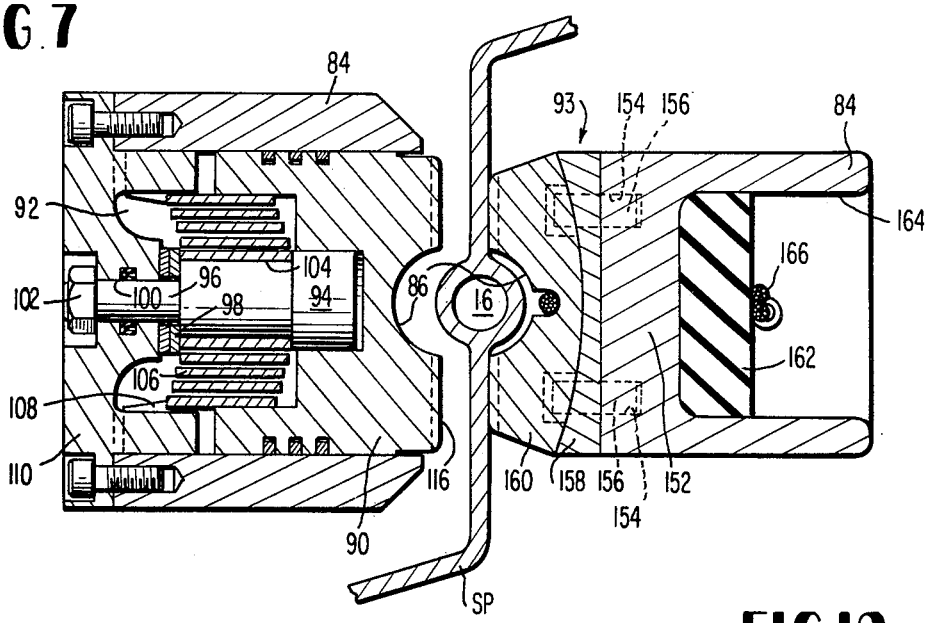
FIG. 7 is a cross-section view on line 7—7 of FIG. 6.

Reference is now made to FIGS. 6 and 7, the latter being a sectional view on line 7—7 of FIG. 6.

As noted earlier herein there are a pair of jaw-like members which serve to attach the vibratory hammer to the piling during the driving operation one of which, 90, is hydraulically actuated while its complemental counterpart, 93, is arranged for lateral adjustment to compensate for possible inaccuracies resulting from production of the sheet piling.

Turing again to FIG. 6, it will be seen that the body portin 84 includes a partition 152, perforated as shown and arranged to have positioned on the front surface thereof a plurally apertured back-up block 158 which in turn is in abutted relation with a die block 160 the front wall of which is serrated to provide gripping teeth to assist in securely fastening that jaw against movement relative to the pile during the driving operation.

Figure 13:
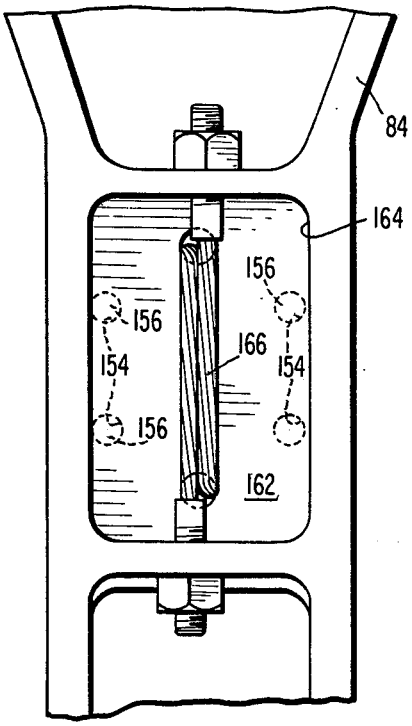
FIG. 13 is a side elevational view on line 13—13 of FIG. 6.

As is shown in FIG. 13, the partition 152 includes a plurality of perforations 154—154 into which are inserted dowel pins 156—156, these pins in turn positively locking the back-up block 158 against any lateral movement while permitting limited or restricted movement of the die block 160.

A rubber cushion 162 seated in the pocket 164 is perforated complementally to the apertures in the partition and when fastened into position as shown by the cable 166, the ends of which include swedged bolt portions that pass through the oppositely disposed perforated walls encompassing the pocket 164, and are held fast therein, as shown, serve to limit slack in the cable 166 to thereby permit lateral movement of the die block 160 to assure accurate positioning of the serrated front surface thereof on the opposite side of the duct 16 and counter to the serrated surface 116.

In FIG. 11 there is shown an enlarged detail in front elevation of another embodiment of the inventive concept of providing apertures in opposite sides of the ducts 16 on each side of the pile, as distinguished from that description presented earlier herein.

In this view there is disclosed a curved area 170 which is formed by a known type of milling cutter (not shown) and thereafter each side of the duct is subjected to a further milling operation to pierce the wall of the duct as shown at 172 to permit jet-like emission of the liquid out over the oppositely extending parallel walls of the piling.

The successive milling operations can be conducted when the sheet piling is in a hot or cold state. Should the sheet be in a hot condition when the first milling cut is made the piercing operation may be performed by a suitable flat tool which is merely positioned in the root of the slot 170 and then driven into the duct to pierce the wall.

It will be apparent to those who are skilled in this art that all of the milling and piercing operations described above can be readily performed automatically on a flat bed table as the sheet is being emitted from either the rolling mill or the extruding mill. For example, opposed milling devices could be mounted on carriers positioned above and/or below the table and extending parallel to each side thereof and arranged to reciprocate toward and away from the duct of the sheet as it advances over a table so that the first milling cut can be made. Naturally, there are distinctly different ways this could be accomplished, i.e., the travel of the sheet could momentarily be interrupted while the milling cutters advance into contact with the sheet, make the cut and then retract, or the sheet could travel continuously on the flat bed while the milling cutters move into contact with the duct, advance longitudinally therewith while making the first milling cut and then return to their initial point of departure so as to once again be reciprocated into contact with the duct to make another milling cut.

It is also contemplated that in lieu of perforating the ducts in the manner described herein as the sheet piling is emitted longitudinally from the machine, it can be moved transversely of the table to another work area where the piercing of the ducts can be conducted sequentially on one side of the piling and then the piling could be turned over and the ducts on that side could then be pierced.

FIG. 12 shows the embodiment of the invention of FIG. 11 in enlarged side elevation with the edge of the sheet piling shown in cross-section. This view clearly shows the first milling cut 170 and the result of the subsequent hot or cold piercing step 172. Also in this side elevational view it is shown at the bottom of the sheet that the duct 16 is flattened to provide a tapered end 174 on the pile which is more suitable for the driving operation.

It is contemplated that the slotting of the sheet piling as described may be accomplished either by the mill that rolls or extrudes the sheet piling or by the rental companies that will place the sheet piling to use.

That which is claimed is:

1. A universal sheet pile clamp for clamping a vibratory hammer to a sheet pile, comprising:

a body portion having means at one end for fixedly connecting the body portion to a vibratory hammer, a slot formed at the other end for receiving the top portion of a sheet pile, and a main blind bore which intersects the slot; and jaw-like members mounted within the main blind bore on either side of the slot for engagement with the sheet pile, said jaw-like members including:

hydraulically actuated piston means on one side of the sheet pile with means for gripping the sheet pile; and laterally adjustable piston means on the other side of the sheet pile with means for gripping the sheet pile.

2. The universal sheet pile clamp as defined in claim 1, wherein the hydraulically actuated piston means includes:

a piston;

a guide member;

a cylinder cap mounted to the body portion, said guide member being fixedly connected to the cylinder cap at one end and defining a piston engaging surface for guiding the piston toward and away from the sheet pile at the other end; and a spring connected to the guide member and the piston for disengaging the piston from the sheet pile when not hydraulically actuated, and wherein the piston, the guide member, the cylinder cap and the main blind bore define a chamber into which a hydraulic medium flows the actuating the piston.

3. The universal sheet pile clamp as defined in claim 1, wherein the body portion has a partition which defines the inner limit of the main blind bore, said partition having a plurality of blind bores formed therein, wherein the laterally adjustable piston means includes:

a back-up block having a surface engageable with the partition and a plurality of apertures formed therein in alignment with the plurality of blind bores;

a die block having a surface engageable with the back-up block, a surface engageable with the sheet pile, and a plurality of blind bores aligned with the plurality of apertures in the back-up block, with the lateral opening of the plurality of blind bores in the die block being greater than the lateral opening of the plurality of apertures formed in the back-up block and the equal plurality of blind bores formed in the partition;

a plurality of dowel pins, one for each of the aligned apertures and blind bores; and fastening means for fastening the back-up block and die block to the partition.

4. The universal sheet pile clamp as defined in claim 3, wherein the fastening means includes a cable, with the back-up block, the die block and partition including apertures for passage of the cable, and means for applying a tension to said cable.

5. The universal sheet pile clamp as defined in claim 4, wherein the body portion defines a pocket the inner extent of which is limited by said partition, and wherein the laterally adjustable piston means further includes a resilient cushion situated within said pocket in engagement with said partition, said resilient cushion having an exposed surface which is engaged by said cable.

6. The universal sheet pile clamp as defined in claim 1, wherein the hydraulically actuated piston means includes:

a piston;

a guide member;

a cylinder cap mounted to the body portion, said guide member being fixedly connected to the cylinder cap at one end and defining a piston engaging surface for guiding the piston toward and away from the sheet pile at the other end; and a spring connected to the guide member and the piston for disengaging the piston from the sheet pile when not hydraulically actuated, said piston, guide member, cylinder cap and main blind bore defining a chamber into which a hydraulic medium flows for actuating the piston; wherein the body portion has a partition which defines the inner limit of the main blind bore, said partition having a plurality of blind bores formed therein, and wherein the laterally adjustable piston means includes:

a back-up block having a surface engageable with the partition and a plurality of apertures formed therein in alignment with the plurality of blind bores;

a die block having a surface engageable with the back-up block, a surface engageable with the sheet pile, and a plurality of blind bores aligned with the plurality of apertures in the back-up block, with the lateral opening of the plurality of blind bores in the die block being greater than the lateral opening of the plurality of apertures formed in the back-up block and the equal plurality of blind bores formed in the partition;

a plurality of dowel pins, one for each of the aligned apertures and blind bores; and fastening means for fastening the back-up block and die block to the partition.

7. The universal sheet pile clamp as defined in claim 6 wherein the fastening means includes a cable, with the back-up block, the die block and partition including apertures for passage of the cable, and means for applying a tension to said cable.

8. The universal sheet pile clamp as defined in claim 7 wherein the body portion defines a pocket the inner extent of which is limited by said partition, and wherein the laterally adjustable piston means further includes a resilient cushion situated within said pocket in engagement with said partition, said resilient cushion having an exposed surface which is engaged by said cable.

9. The universal sheet pile clamp as defined in claim 1, wherein the body portion has a passage which is aligned with and extends into the slot, and a plurality of bores which intersect said passage, the universal sheet pile clamp further comprising:

an injector mounted within said passage, with one end of said injector extending into the slot for engagement with the sheet pile, said injector defining an opening coaxial with said passage;

biasing means mounted within said passage and connected to the other end of the injector for biasing the injector away from the sheet pile; and means mounted to the body portion for introducing a fluid lubricant to the plurality of bores for delivery into said passage and opening to the sheet pile.

10. The universal sheet pile clamp as defined in claim 9, wherein said other end of the injector defines a surface against which the fluid lubricant applies a force which is directed opposite to the force exerted by the biasing means.

11. The universal sheet pile clamp as defined in claim 10, wherein the fluid lubricant introducing means comprises a split collar and fastening means for fastening the split collar to the body portion, said split collar defining a manifold chamber for conducting the fluid lubricant to individual ones of the plurality of bores.

* * * * *